US007735343B2

(12) United States Patent
Chochol et al.

(10) Patent No.: US 7,735,343 B2
(45) Date of Patent: Jun. 15, 2010

(54) SEALING HEAD FOR MACHINES FOR THERMAL TREATMENT OF FILAMENTS

(75) Inventors: Antoine Chochol, Kingersheim (FR); Hubert Liebmann, Wittenheim (FR)

(73) Assignee: Superba (SAS), Mulhouse (FR)

( * ) Notice: Subject to any disclaimer, the term of this patent is extended or adjusted under 35 U.S.C. 154(b) by 935 days.

(21) Appl. No.: 11/514,946

(22) Filed: Sep. 5, 2006

(65) Prior Publication Data

US 2007/0056690 A1 Mar. 15, 2007

(30) Foreign Application Priority Data

Sep. 13, 2005 (FR) ..... 05 09341

(51) Int. Cl.
*D06B 3/04* (2006.01)

(52) U.S. Cl. ..... 68/5 E; 68/5 D

(58) Field of Classification Search ..... 68/5 E, 68/5 D

See application file for complete search history.

(56) References Cited

U.S. PATENT DOCUMENTS

| | | | | | |
|---|---|---|---|---|---|
| 1,595,240 | A | * | 8/1926 | Minton | 34/452 |
| 2,335,462 | A | * | 11/1943 | Sommerville | 264/136 |
| 2,541,301 | A | * | 2/1951 | Sissler | 15/256.5 |
| 2,933,773 | A | * | 4/1960 | Noguera | 184/102 |
| 3,260,000 | A | * | 7/1966 | Schiffer | 34/242 |
| 3,367,151 | A | * | 2/1968 | Fujihashi | 68/5 E |
| 3,383,591 | A | * | 5/1968 | Roberts | 324/71.1 |
| 3,494,041 | A | * | 2/1970 | Freeman | 33/702 |
| 3,505,844 | A | * | 4/1970 | Mclean | 72/42 |
| 3,573,875 | A | * | 4/1971 | Zuczek | 277/399 |
| 3,911,704 | A | * | 10/1975 | Bridenbaugh et al. | 72/42 |
| 4,086,871 | A | * | 5/1978 | Rydeen et al. | 399/325 |
| 4,186,571 | A | | 2/1980 | Gorodissky et al. | |
| 4,214,758 | A | | 7/1980 | Gorodissky et al. | |
| 4,334,188 | A | * | 6/1982 | Dudley | 324/133 |
| 4,653,303 | A | * | 3/1987 | Richard | 72/236 |
| 4,899,779 | A | * | 2/1990 | Stuart | 137/269 |
| 4,949,558 | A | * | 8/1990 | Enderlin | 68/5 E |
| 5,045,889 | A | * | 9/1991 | Hoover | 399/325 |
| 5,074,130 | A | | 12/1991 | Enderlin | |
| 5,746,891 | A | * | 5/1998 | Withers | 162/371 |
| 6,349,813 | B1 | * | 2/2002 | Offerman et al. | 198/328 |
| 6,677,749 | B2 | * | 1/2004 | Butikofer et al. | 324/226 |
| 7,032,740 | B2 | * | 4/2006 | Hochhaus et al. | 198/502.1 |

FOREIGN PATENT DOCUMENTS

| | | | |
|---|---|---|---|
| DE | 100 13 343 | * | 9/2001 |
| GB | 2 109 480 | * | 6/1983 |
| JP | 62-165096 | * | 7/1987 |
| SU | 1371796 | * | 2/1988 |

* cited by examiner

*Primary Examiner*—Frankie L Stinson
(74) *Attorney, Agent, or Firm*—Young & Thompson

(57) ABSTRACT

A sealing head for machines for the thermal treatment of filaments, includes a frame (1) fixed to a pressurized chamber traversed by a conveyor belt, a pair of superposed horizontal rollers (2 and 3), which are pressed against opposite surfaces of the conveyor belt, and sealing elements (4 and 5) to form a sealed closure between the rollers (2 and 3) and the frame (1). The sealing elements (4 and 5) to form a sealed closure between the rollers (2 and 3) and the frame (1) are each provided with integrated lubricating elements (4', 5'), under pressure or by capillarity. The invention is more particularly applicable to the field of the textile industry, in particular the treatment of filaments by thermal treatment machines presently called thermofixation machines.

17 Claims, 3 Drawing Sheets

SEALING HEAD FOR MACHINES FOR THERMAL TREATMENT OF FILAMENTS

The present invention relates to the field of the textile industry, in particular the treatment of filaments by means of thermal treatment machines now called thermofixation machines and particularly sealing heads of such machines, and has for its object such a sealing head.

The machines for thermal treatment of filaments are essentially constituted by a pressurized chamber for thermal treatment of textile filaments disposed on a conveyor belt passing through said chamber, which is closed at its two ends by sealing heads each comprising a frame fixed to the pressurized chamber, a pair of horizontal rollers that are superposed or adjacent in a horizontal plane, which are pressed against opposite surfaces of the conveyor belt and ensure driving of the material, as well the conveyor belt, and sealing means to form a sealed closure between the rollers and the frame.

In a known machine of this type, according to U.S. Pat. No. 5,074,130, the horizontal rollers are provided with sealing means in the form, on the one hand, of an upper element and a lower elongated element and each bearing against a generatrix of the two rollers and, on the other hand, by lateral sealing plates bearing slidably against the corresponding ends of the rollers. The application of the sealing means, whether horizontal or vertical, is effectuated by actuators, in the form of high pressure hydraulic jacks.

These sealing means are present in the form, on the one hand, of an upper element and a lower elongated element and bear against the generatrices of the two rollers and, on the other hand, by lateral sealing plates bearing slidably against the corresponding ends of the rollers.

At present, the upper and lower element forming the longitudinal sealing means of the two rollers are constituted each by a sealing blade mounted on a pivotal support bearing on the frame by means of a pivotal longitudinal abutment, and each coacting with one or several corresponding actuators, whilst the lateral sealing plates bearing slidably against the corresponding ends of the rollers are metallic plates covered, in their friction zone, with teflon plating, these platings being applied under pressure against said ends.

Because of the driving in rotation of the superposed horizontal rollers, there is produced against these latter and the corresponding sealing means a friction with the fixed sealing parts and thus a wear of the constituent materials of these sealing means. It is thus necessary to reduce the intensity of this friction.

To this end, it has been proposed to provide sealing blades constituting longitudinal sealing means for the two rollers of a low coefficient of friction material or else of a self lubricating material. However, these known materials do not permit satisfactorily solving the problem of wear of the longitudinal sealing means.

It has also been proposed to provide the longitudinal sealing means, downstream of their line of contact with the rollers, seen in the direction of rotation of said rollers, with an external lubricating device for the surface of the rollers, such that these latter drive the lubricating product into the contact zone between the fixed sealing blades and the rollers. However, as to the inlet head of the treatment chamber, there is the risk of entering into contact of the lubricant with the product to be treated, which could have the effect of modifying the characteristics of the treatment, or even giving rise to pollution of said product to be treated.

Moreover, there is also known, from U.S. Pat. No. 4,186,571 and from U.S. Pat. No. 3,367,111, means provided with horizontal adjacent rollers in a horizontal plane. The problem of sealing against the rollers thus arranged is not comparable to that encountered with superposed rollers and the corresponding solution are not reproducible in such a configuration of superposed rollers.

The present invention has for its object to overcome these drawbacks by proposing sealing means for sealing heads of thermotreatment machines, in particular for the treatment of filaments, called thermofixation machines, permitting substantially reducing the intensity of the friction and the wear of the elements in contact.

To this end, the sealing head for machines for the thermal treatment of filaments, which is essentially constituted by a frame fixed to a pressurized chamber traversed by a conveyor belt, by a pair of superposed horizontal rollers, which are pressed against opposite surface of the conveyor belt, and by sealing means to form a sealed closure between the rollers and the frame, one at least of the horizontal rollers and the sealing means being connected to actuators for corresponding movement, is characterized in that the sealing means to form a sealed closure between the rollers and the frame are each provided with integrated lubricating means under pressure or by capillarity, each lubricating means being of the integrated type under pressure, having the shape of a porous body disposed between the support forming the sealing means and the horizontal superposed rollers and being connected by its surface turned toward said support to a means for distributing a lubricant under pressure, said means being connected externally of the support to a supply conduit for lubricant under pressure.

The invention will be better understood from the following description, which relates to a preferred embodiment, given by way of non-limiting example, and explained with reference to the accompanying schematic drawings, in which.

Figure 1:
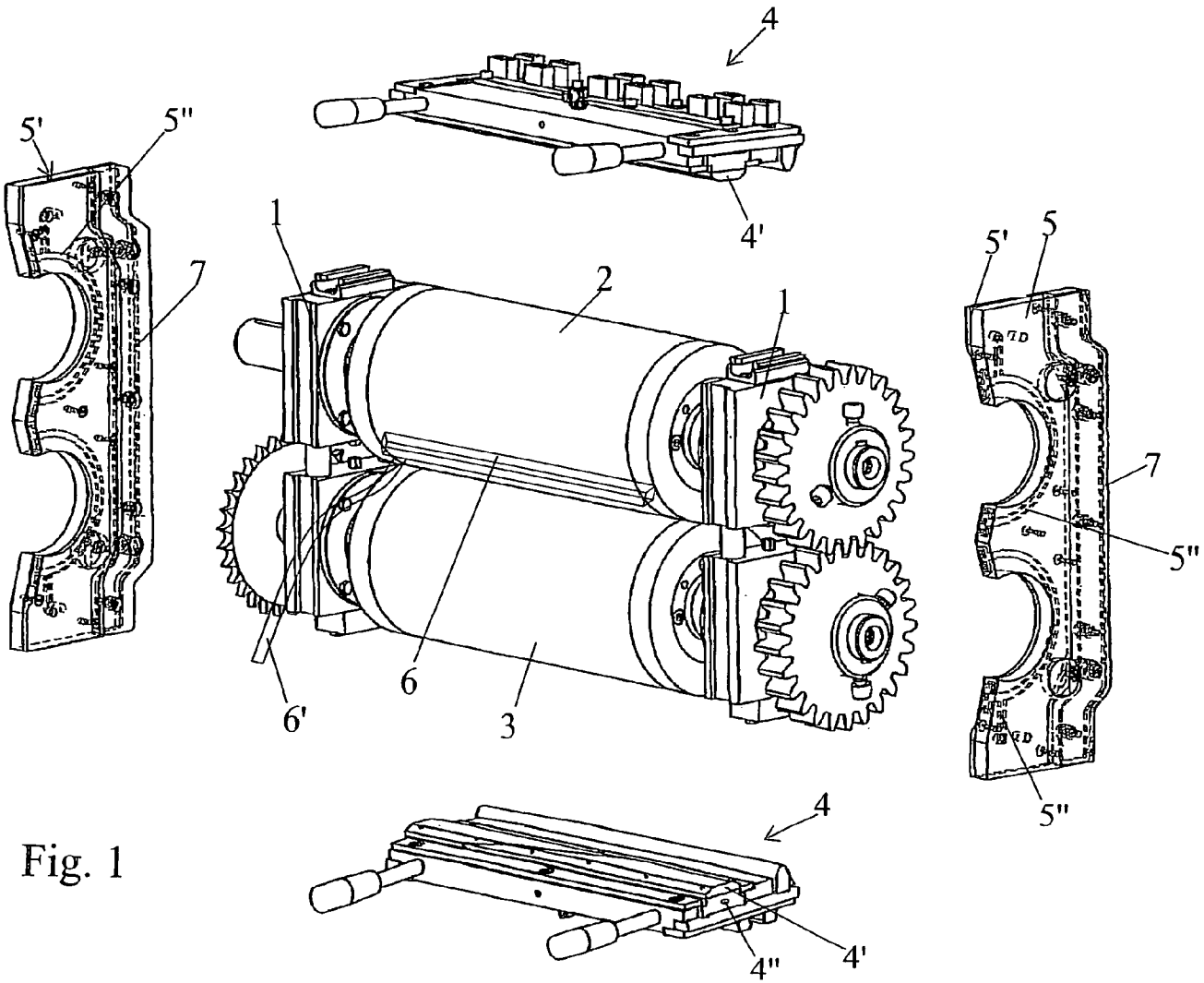
FIG. 1 is an exploded perspective view of a sealing made according to the invention.

FIG. 1 of the accompanying drawings shows, by way of example, a sealing head for machines for the thermal treatment of filaments, which is essentially constituted by a frame 1 fixed to a pressurized chamber (not shown) traversed by a conveyor belt (not shown), by a pair of horizontal superposed rollers 2 and 3, which are pressed against the opposite surfaces of the conveyor belt, and by sealing means 4 and 5 to form a sealed closure between the rollers 2 and 3 and the frame 1, at least one, 2, of the horizontal rollers and the sealing means 4 and 5 being connected to actuators for corresponding movement, not shown in detail. The frame 1 not forming a part of the present invention, is represented only by two lateral uprights for reception of the rollers 2 and 3.

Figure 2:
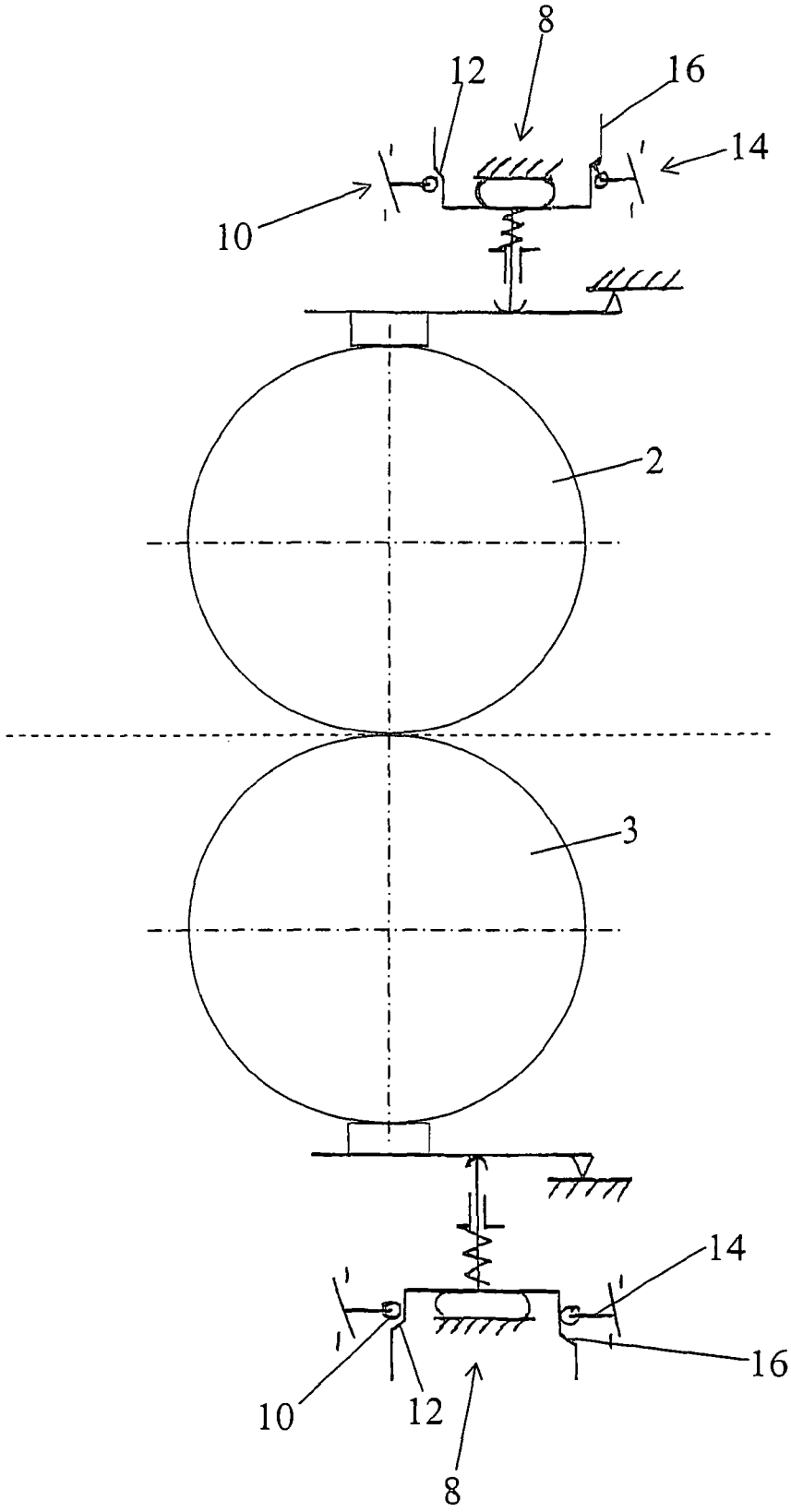
FIG. 2 is a schematic side elevational view, on a larger scale, representing a wear detection means for the longitudinal sealing means of the two rollers.
Figure 3:
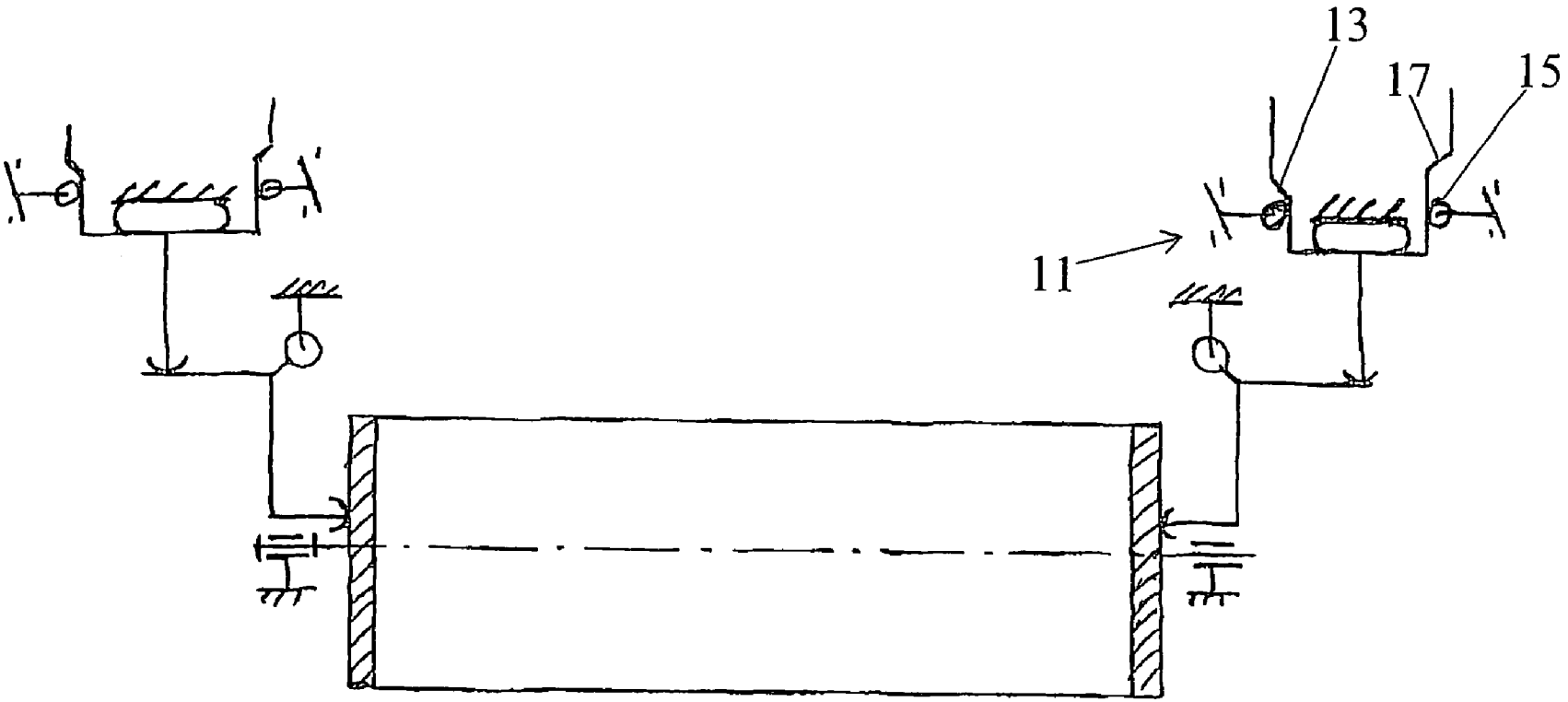
FIG. 3 is a schematic plan view and in cross-section, on a larger scale, showing a wear detection means for the lateral sealing means of the two rollers.

Moreover, as shown in FIGS. 2 and 3 of the accompanying drawings, the sealing means 4 and 5 are applied under pressure against the corresponding surfaces of the rollers 2 and 3 respectively, by means of actuators 8 and 9, which consist of jacks applied, on the one hand, against the sealing means 4, so as to carry out swinging of these latter tending to apply their active portion against the lateral generatrix of the horizontal rollers 2 and 3 and, on the other hand, against the sealing means 5 so as to press these latter by means of return levers 9' against the ends of the rollers 2 and 3.

According to the invention, the sealing means 4 and 5 to form a sealed closure between the rollers 2 and 3 and the frame 1 are each provided with integrated lubricating means 4', 5', under pressure or by capillarity. Each lubricating means is of the integrated type under pressure 4', 5', and can be present in the form of a porous body disposed between the support 4, 5 forming the sealing means and the horizontal superposed rollers 2 and 3 and is connected by its surface turned toward said support 4, 5 to a means 4", 5" for distribution of a lubricant under pressure, said means 4", 5" being connected, externally of the support 4, 5 to a supply conduit for lubricant under pressure.

Thus, a lubricant under pressure can be brought through the supports 4 and 5 forming the sealing means against the rear surface of the porous body forming each lubricating means integrated under pressure 4', 5' and thus be distributed in said porous body to migrate in the direction of their bearing surface against the horizontal rollers 2 and 3. It follows that the lubricant is applied against the surfaces of the rollers 1 and 2 in contact with the sealing means 4 and 5, such that the friction between said surfaces and said sealing means is reduced.

According to another characteristic of the invention, the means 4", 5" for distribution of a lubricant under pressure are preferably provided in the supports 4, 5 forming the sealing means and extend along generatrices near those of the horizontal rollers 2 and 3, namely parallel to the longitudinal axes of said rollers in the supports 4 and following the portion of a circle concentric to the axle of the corresponding rollers, near the diameter of said axle.

Thus, there is obtained a distribution of the lubricating fluid over all the surfaces in contact, such that the lubrication takes place in an optimal manner, in the form of a regular film. Thus, by such an arrangement of the means 4" and 5", the lubricant is automatically brought against the assembly of the horizontal surface of the rollers 2 and 3 by the sealing means 4 and over all the end surface of the rollers 2 and 3 by the sealing means 5. In this latter case, the centrifugal force has a tendency to promote a radial distribution of the lubricating fluid.

The creation of a lubricating film on the rollers 2 and 3 can, as a function of the fluid lubricant used, be considered as negligible as to the eventual moistening of the product treated in the treatment chamber of the machine. The same is true for the lubrication of the ends of the rollers 2 and 3. In this latter case, the film can even have a greater thickness.

However, as a function of the type of lubricant used, it can be interesting, or even necessary, to recover said lubricant or to carry out a drainage of the latter toward an outlet. To this end, it can be provided, according to another characteristic of the invention, as shown in FIG. 1 of the accompanying drawings, to outfit the sealing head of means 6 and 7 for recovery and/or drainage of the lubricating fluid distributed respectively over the cylindrical surfaces of the rollers 2 and 3 and on the end surfaces of these rollers 2 and 3.

Thus, the means 6 for recovery and/or drainage of the lubricating fluid belonging to the horizontal rollers 2 and 3 can be present in the form of scraping gutters applied by one edge against a generatrix of each roller 2 and 3 and provided with a conduit 6' for connection to a central reservoir or to a circulation pump returning the fluid into the lubricating circuit.

In the particular case of the horizontal roller 2 entering into contact with the product to be treated, the means 6 for recovery and/or drainage of the lubricating fluid is preferably disposed along a generatrix near the entry of the sealing head and hence of the conveyor belt. For the horizontal roller 3 forming the lower portion of the sealing head, the means 6 for recovering and/or draining lubricating fluid can preferably be mounted directly on the support 4 forming the sealing means, parallel to the integrated lubrication means under pressure 4'. Thus, in this latter case, because the horizontal roller 3 does not enter into contact with the product to be treated, the lubricating fluid can remain on said roller 3 during almost all the period of revolution and the means 6 serves essentially to recover the remaining fluid to avoid dispersion of this latter.

The means 7 for recovering and/or draining the lubricating fluid distributed over the end surfaces of the rollers 2 and 3 can preferably be present in the form of one or several channels extending at least to the end of the sealing means 5 entering into the treatment chamber of the treatment machine, these channels being connected to a recovery reservoir or to a circulation pump. Thus, the lubricating fluid which tends to be directed inwardly of the chamber penetrates the channel or channels forming the means 7 provided for this purpose, such that it can in no way escape toward the treatment chamber.

According to another embodiment of the invention, not shown in the accompanying drawings, the integrated lubricating means 4', 5' are of the capillary type and are connected by distribution channels or the like to one or several reservoirs for distribution at a constant level, these reservoirs being adapted, as the case may be, to be supplied by the means 6, 7 for recovery and/or draining of the lubricating fluid.

Because of the friction between the fixed members, namely the sealing means 4 and 5 and the horizontal rollers 2 and 3, there takes place a more or less rapid wear of the different members in contact, as a function of the conditions of use of the treatment chamber, namely of the speed of movement of the products, of the internal pressure and hence of the pressure to be applied to carry out sealing, as well as the type of filaments.

To this end, it is necessary to control the wear of the fixed sealing members 4 and 5, so as to carry out their replacement as needed, which is to say before their destruction, which would risk giving rise to prolonged stoppage of the machine.

According to another characteristic of the invention, to overcome this drawback, there is provided, moreover, that the sealing head has means for the detection of wear of the sealing means 4 and 5, in particular on their surface in contact with the longitudinal sealing rollers 2 and 3, both along their generatrix and at their ends, which consist in at least one movement detector 10, 11 belonging to the application means of said sealing devices against the surfaces of the horizontal rollers 2 and 3.

FIGS. 2 and 3 of the accompanying drawings show for this purpose schematically, respectively in side elevation and plan view, the application of the sealing means 4 and 5 against the corresponding surfaces of the rollers 2 and 3.

According to a preferred embodiment of the invention, the movement detectors 10 and 11 belonging respectively to the sealing means 4 and 5 are each present in the form of at least one end of movement contact coacting with a cam 12, 13 provided on the piston rod or a transmission rod of the actuator 8, 9 for pressurizing the application of the sealing means 4, 5, this cam 12, 13 entering into contact with the detector 10, 11 after a movement corresponding to optimum wear of the sealing means 4 and 5. The language "optimum wear of the sealing means 4 and 5" means wear of these means 4 and 5 permitting ensuring sealing whilst avoiding deterioration of a contact surface.

The detectors 10 and 11 coact with the cams 12 and 13 permitting detecting the decrease of the thickness of the sealing means 4 and 5, resulting from their wear, this by taking into account the corresponding movement of the piston rod or transmission rod of the actuators 8 and 9 and the path of the cam 12 or 13 of these latter as predefined to correspond to optimum wear, such that upon reaching a corresponding wear threshold, a replacement for preventive maintenance is to be carried out.

To this end, according to another characteristic of the invention, the end of path contacts corresponding to optimum wear are preferably connected to a light and/or sound signaling means and/or by display warning the operator of the need for replacement of the sealing means.

For reasons of safety, it can be provided, according to another characteristic of the invention, to provide each actuator 8, 9 of the sealing means 4, 5 with supplemental means for detecting extreme wear 14, 15, detecting a maximum movement of the sealing means 4, 5 in the direction of the corresponding surfaces of the horizontal rollers 2, 3 and delivering an automatic stop signal to the machine and an alarm for detection of a level of ultimate wear.

Preferably, the supplemental means for detecting extreme wear 14, 15 are also in the form of end of path contacts and coact respectively with the cams 16, 17 also provided on the piston rod or transmission rod of the actuators 8, 9. The end of path contacts forming the supplemental extreme wear detection means 14, 15 are also connected to visual and/or sonic and/or display alarm means, as well as to an emergency cutoff of all the energy supply of the machine.

The cams 16, 17 are comparable to those 12, 13 and simply have relative to these latter a greater length of path of the piston rod or transmission rod of the actuators 8, 9.

Thus, it is possible to detect in the first instance normal wear of the sealing means 4 and 5 and to proceed to corresponding maintenance operations with a completely foreseeable downtime and, in the case in which this first delay has been forgotten, to give rise to automatic stopping of the machine, so as to avoid any risk of destruction of the sealing head.

According to a modified embodiment of the invention, not shown in the accompanying drawings, the wear detection means 10, 11 and the supplemental extreme wear detection means 14, 15 can be replaced either by an inductive detector, or by a ground contact mounted on a support arm or an actuating means intermediate the sealing means 4, 5 and coacting with one or several end of path contacts, either by a visual detector or by a combination of the visual detector and a ground contact.

In the case of use of a ground contact, it can be provided that the mechanical element of this latter actuates successively two end of path contacts respectively for normal wear and for extreme wear and that its movement will be visualized, for example by displaying warning and alert colors.

Thanks to the invention, it is possible to improve very substantially the operation of a sealing head for a machine for thermal treatment of filaments, by ensuring better sealing between the movable elements and the fixed elements, whilst ensuring less wear of the sealing means.

Moreover, the wear of said sealing means can be perfectly controlled, such that preventive maintenance can be carried out and the security of operation of the sealing head and as a result of the assembly of the machine, can be completely ensured.

Of course, the invention is not limited to the embodiment described and shown in the accompanying drawings. Modifications remain possible, particularly as to the construction of the various elements or by substitution of technical equivalents, without thereby departing from the scope of protection of the invention.

The invention claimed is:

1. Sealing head for machines for thermally treating filaments, which is essentially constituted by a frame (1) fixed to a pressurized chamber traversed by a conveyor belt, by a pair of horizontal superposed rollers (2 and 3), which are pressed against opposite surfaces of the conveyor belt, and by sealing means 4 and 5 to form a sealed closure between the rollers (2 and 3) and the frame (1), at least one (2) of the horizontal rollers and the sealing means (4 and 5) being connected to actuators for corresponding movement (8 and 9) characterized in that the sealing means (4 and 5) to form a sealed closure between the rollers (2 and 3) and the frame (1) are each provided with an integrated lubricating means (4', 5'), under pressure or by capillarity, each lubricating means being of the integrated type under pressure (4'), (5'), being present in the form of a porous body disposed between the support (4, 5) forming the sealing means and the superposed horizontal rollers (2 and 3) and being connected by its surface turned toward said support (4, 5) to a means (4", 5") for distributing a lubricant under pressure, said means (4", 5") being connected, externally of the support (4, 5), to a supply conduit for lubricant under pressure, means for detecting wear (10, 11) of the sealing means (4 and 5), including their surface in contact with the longitudinal sealing rollers (2 and 3) both along their generatrix and at their ends, wherein the wear detection means (10, 11) comprises at least one movement detector (10, 11) belonging to the application means of the sealing devices against the surfaces of the horizontal rollers (2 and 3), and the movement detectors (10 and 11) belonging respectively to the sealing means (4 and 5) are each present in the form of at least one end of path contact coacting with a cam (12, 13) provided on a piston rod or a transmission rod of the actuator (8, 10) for pressurizing the application of the sealing means (4, 5), this cam (12, 13) entering into contact with the detector (10, 11) after a movement corresponding to optimum wear of the sealing means (4 and 5).

2. Sealing head according to claim 1, characterized in that the means (4", 5") for distributing a lubricant under pressure are provided in the supports (4, 5) forming the sealing means and extending along generatrices near those of the horizontal rollers (2 and 3), namely parallel to the longitudinal axes of said rollers in the supports (4) and along a portion of a circle concentric to the axle of the corresponding rollers, near the diameter of said axle.

3. Sealing head according to claim 2, characterized in that it is provided with means (6 and 7) for recovery and/or drainage of the lubricant distributed respectively over the cylindrical surfaces of the rollers (2 and 3) and on the end surfaces of these rollers (2 and 3).

4. Sealing head according to claim 1, characterized in that it is provided with means (6 and 7) for recovery and/or drainage of the lubricating fluid distributed respectively over the cylindrical surfaces of the rollers (2 and 3) and on the end surfaces of these rollers (2 and 3).

5. Sealing head according to claim 4, characterized in that the means (6) for recovery and/or drainage of the lubricating fluid belonging to the horizontal rollers (2 and 3) is present in the form of scraping gutters applied by one edge against a generatrix of each roller (2 and 3) and provided with a conduit (6') for connection to a central reservoir or to a circulation pump returning the fluid into the lubrication circuit.

6. Sealing head according to claim 4, characterized in that the means (6) for recovery and/or drainage of the lubricating fluid is disposed along one generatrix near the inlet of the sealing head and thus of the conveyor belt.

7. Sealing head according to claim 4, characterize in that the means (6) for recovery and/or drainage of the lubricating fluid is mounted directly on the support (4) forming the sealing means, parallel to the integrated lubrication means under pressure (4').

8. Sealing head according to claim 4, characterized in that the means (7) for recovery and/or drainage of the lubricating fluid distributed over the end surfaces of these rollers (2 and 3) is present in the form of one or several channels extending at least to the end of the sealing means (5) entering the treatment chamber of the treatment machine, these channels being connected to a recovery reservoir or to a recirculation pump.

9. Sealing head according to claim 1, characterized in that the integrated lubricating means (4', 5'), are of the capillarity type and are connected, by distribution channels or the like, to one or several constant level distribution reservoirs, these reservoirs being adapted, as the case may be, to be supplied by the means (6, 7) for recovery and/or drainage of the lubricating fluid.

10. Sealing head according to claim 1, characterized in that the end of path contacts corresponding to optimum wear are connected to a luminous and/or sonic and/or display signaling means warning the operator of the need to replace the sealing means.

11. Sealing head according to claim 1, characterized in that each actuator (8, 9) of the sealing means (4, 5) is provided with a supplemental means for detecting extreme wear (14, 15) detecting a maximum path of movement of the sealing means (4, 5) in the direction of the corresponding surfaces of the horizontal rollers (2, 3) and delivering an automatic stop signal to the machine and an alarm for detection of an ultimate level of wear.

12. Sealing head according to claim 11, characterized in that the supplemental means for detecting extreme wear (14, 15) are also in the form of end of path contacts and coact respectively with cams (16, 17) also provided on the piston rod or the transmission rod of the actuators (8, 9).

13. Sealing head according to claim 11, characterized in that the end of path contacts forming the supplemental means for detecting extreme wear (14, 15) are connected to visual and/or sonic and/or display alarm means as well as to an emergency cutoff contact of all the supplies of energy to the machine.

14. Sealing head according to claim 11, characterized in that the wear detection means (10, 11) and the supplemental means for detecting extreme wear (14, 15) are replaced by an inductive detector.

15. Sealing head according to claim 11, characterized in that the wear detection means (10, 11) and the supplemental means for detecting extreme wear (14, 15) are replaced by a ground contact mounted on a support arm or an intermediate actuating means of the sealing means (4, 5) and coacting with one or several end of path contacts.

16. Sealing head according to claim 11, characterized in that the wear detection means (10, 11) and the supplemental means for detecting extreme wear (14, 15) are replaced by a visual detector.

17. Sealing head according to claim 11, characterized in that the wear detection means (10, 11) and the supplemental means for detecting extreme wear (14, 15) are replaced by a combination of a visual detector and a ground contact.

* * * * *